United States Patent [19]

Boettcher

[11] 4,363,422

[45] Dec. 14, 1982

[54] HELICAL VENDING MACHINE WITH EXPANSIBLE DIVIDER

[75] Inventor: William C. Boettcher, Foley, Mo.

[73] Assignee: D.O.V.E. Equipment Corporation, Winfield, Mo.

[21] Appl. No.: 248,556

[22] Filed: Mar. 27, 1981

Related U.S. Application Data

[63] Continuation-in-part of Ser. No. 35,421, May 2, 1979, Pat. No. 4,258,860, and Ser. No. 139,991, Apr. 14, 1980, Pat. No. 4,312,460.

[51] Int. Cl.[3] ..... G07F 11/36

[52] U.S. Cl. ..... 221/75; 221/242

[58] Field of Search ..... 221/75, 241, 242; 198/778, 659, 661, 670

[56] References Cited

U.S. PATENT DOCUMENTS 4,258,860 3/1981 Boettcher ..... 221/75

4,312,460 1/1982 Boettcher ..... 221/75

*Primary Examiner*—Stanley H. Tollberg

*Attorney, Agent, or Firm*—Gravely, Lieder & Woodruff

[57] ABSTRACT

This invention involves a vending machine having helix discharge units. The units are used to store and dispense packaged objects such as chip products, candy, mints, chewing gum, candy bars, cigarettes, cigars, etc. The unit preferably utilizes a rotatable helix dispensing spindle having a central divider within the convolutions of the helix which divides the helix into separate side-by-side compartments and is expansible to vary the size of the compartments to accommodate different size packages.

8 Claims, 7 Drawing Figures

HELICAL VENDING MACHINE WITH EXPANSIBLE DIVIDER

REFERENCE TO PRIOR APPLICATIONS

This application contains subject matter in common with and is a continuation-in-part of co-pending applications Ser. No. 35,421, filed May 2, 1979 now U.S. Pat. No. 4,258,860, and Ser. No. 139,991, filed Apr. 14, 1980 now U.S. Pat. No. 4,312,460.

BACKGROUND OF THE INVENTION

This invention relates generally to vending machines, and more particularly to those which utilize a helical coil to advance items from a storage position within the machine to a chute for discharge to the consumer. U.S. Pat. Nos. 3,178,055, 3,335,907, and 3,601,281 disclose various vending machines of this type. The machines usually have a discharge chute mounted on the front or at the side and are designed to hold a plurality of individual item discharge units. The units each have a tray with a helical coil mounted therein. Items are advanced by rotation of the coil by means of a motor activated by the customer after money is deposited in the machine.

One problem with these types of vendors, which is addressed in U.S. Pat. No. 4,258,860, is that of providing different sized compartments in the units to accommodate different sized packages.

Economy of manufacture dictates that the individual units, and hence the trays, be of identical construction. The consumer, however, demands that a wide range of products be made available to him through vending machines. The size and shape of the packaging for these various products varies from the typical sack for potato chips and the like, to packages of various sizes of cigarettes, and to still other packages for thin or little cigars, mints, lifesavers, gum and other products.

The problem for a manufacturer, therefore, is to provide a standard-sized tray, based quite often on a size necessary for vending cigarette packages, which is readily convertible to handling the smaller mint, gum, or candy bar packages.

While there are various methods for changing the size of the compartments, these earlier devices all result in compartments of fixed size, so that if the operator of the machine wished to change the size on site he needs to disassemble part or all of the unit and possibly has to take the unit back to his base of operations. It is quite desirable that a method be provided for adjusting the size of the units at the site, so that popular items can be included in a particular machine even if they happen to differ in size from the items currently vended from the machine.

Among the patents which have attempted to utilize a spacer of some sort to reduce the size of the compartments are Wirstlin U.S. Pat. No. 3,908,858, and Wittern U.S. Pat. No. 3,929,255. However, neither of these units is completely adjustable on site and does not achieve all of the objects and advantages of the present invention.

Accordingly, it is a principal object of the present invention to provide a helical vending unit having an adjustable divider positioned within the helix to change the size of the merchandise compartments encompassed by the helix and the tray in which the helix turns.

These and other objects and advantages will become apparent hereinafter.

SUMMARY OF THE INVENTION

The present invention comprises a vending machine unit in which a helix turns in a tray to progress items toward the open end of the tray and an expansible divider means within the helix to change the spacing between the side walls of the tray and the edges of said divider, whereby articles of different widths can be accommodated in the convolutions of the helix.

In the drawings wherein like numbers refer to like parts wherever they occur:

Figure 1:
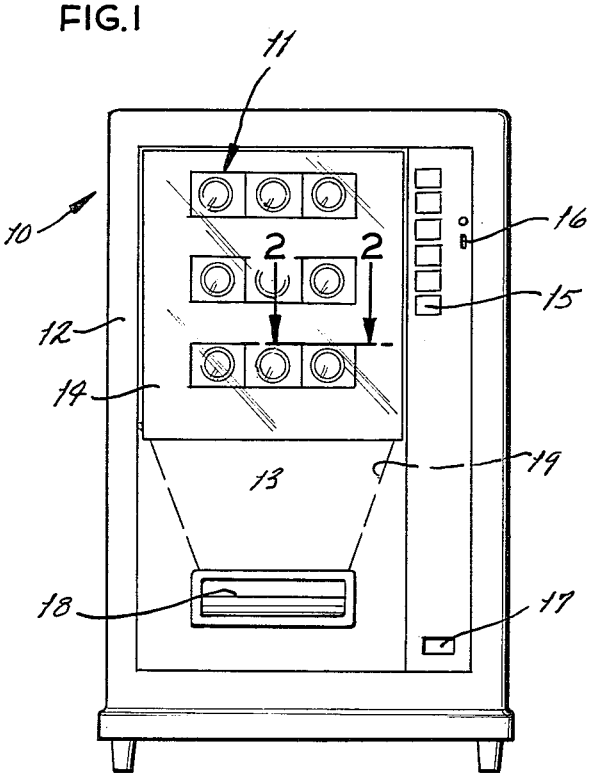
FIG. 1 is a front elevational view showing a vending machine having individual units incorporated therein.

The present invention is embodied in a vending machine 10 (FIG. 1) having a plurality of helix discharge units indicated generally by the numeral 11 which preferably are disposed in side-by-side horizontal and/or vertical relationship within the storage compartment portion of the machine 10. If desired, the units 11 can be used individually, but the more usual arrangement is a bank within a cabinet 12 as shown . The cabinet or storage compartment 12 includes a front door 13 having a clear see-through window portion 14 through which the customer may view the merchandise residing in the units 11. Mounted on the machine 10 are selection means 15 which activate the individual units 11, a coin slot 16 and a coin return 17. A discharge opening 18 positioned at the lower portion of the door 13 is connected to a discharge chute 19 which connects with the open front end of the vend units 11.

Figure 2:
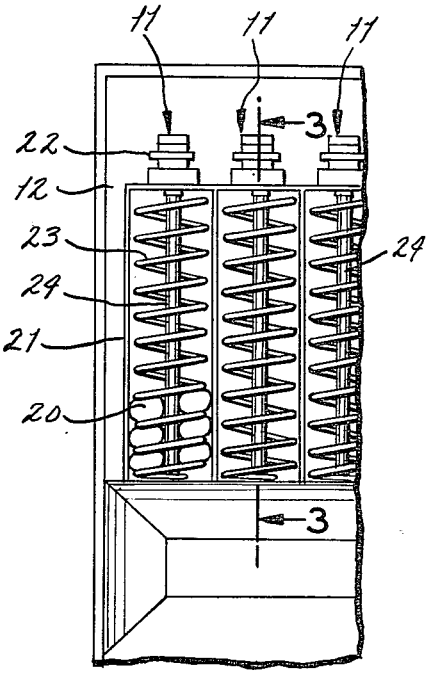
FIG. 2 is a sectional view taken along line 2—2 of FIG. 1 showing several of the individual vend units in plan.

A plurality of packaged items 20, such as rolls of mints, packages of gum, or the like are positioned within each helix discharge unit 11 (FIG. 2). The discharge units 11 are designed so that they can be moved into or out of the cabinet 12 for refilling. Each of the units 11 is similar and preferably comprises a tray assembly 21, a drive unit 22, a helix 23, and an adjustable divider mechanism 24.

In the form of the invention shown, the helix 23 is known as a front driven helix which means that there is a positive connection between the drive means 22 and the leading edge 25 of the helix 23.

The tray assembly unit 21 comprises a bottom wall 30, side walls 32, and a rear wall 33. The drive unit 22 is attached to the back side of the rear wall 33 and has a drive shaft 34 in which a drive rod 35 is positioned and caused to rotate therewith by means of flattened engagement of internal surfaces (not shown). The drive rod is an extension of the leading edge of the helix 23 and is enclosed in the divider unit 24. Thus, when the drive unit 22 is energized, the drive shaft 34 rotates the drive rod 35 and consequently the leading edge 25 of the helix 23 is rotated to propel the packages 20 stored within the convolutions of the helix 23 toward the open end of the tray assembly 21. The outermost package 20 is propelled out of the tray assembly 21 into the discharge chute 19. The unit is set up so that a package is discharged with each 180° rotation of the helix 23.

The divider 24 is incrementally adjustable between closed or contracted and open or expanded positions so as to provide a means for adjusting the width of the side-by-side compartments A and B defined between the divider 24 and the tray side walls 32.

Figure 3:
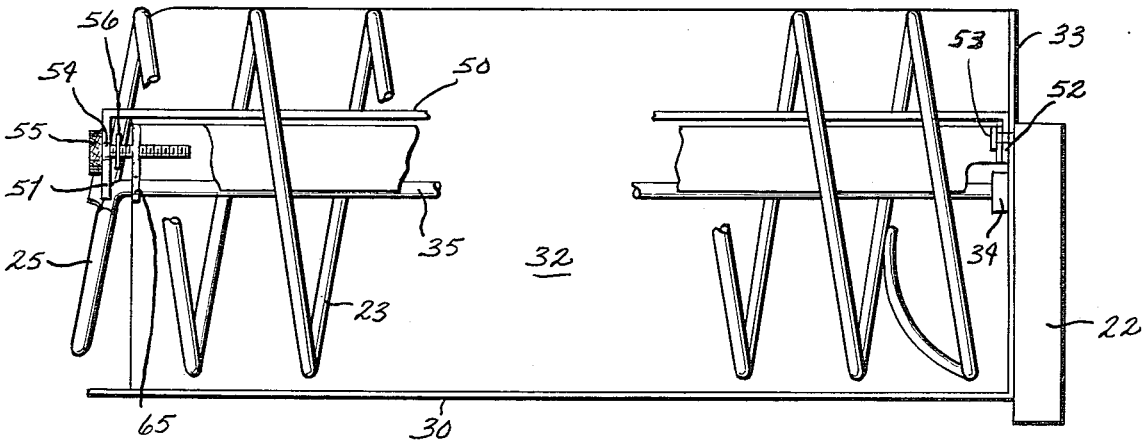
FIG. 3 is a vertical sectional view taken along line 3—3 of FIG. 2.

The divider mechanism 24 comprises an elongated main mounting member 50 which has downwardly bent end flanges 51 and 52 at its forward and rear ends respectively (FIG. 3). The rear flange 52 engages the rear wall 33 and is fastened thereto by means 53. This holds the entire divider mechanism 24 horizontally centered within the helix.

The forward flange 51 is provided with an opening 54 which holds a threaded knurled head adjusting screw 55. The adjusting screw 55 is retained in the opening 54 by a screw retainer 56 positioned adjacent to the inside surface of the flange 51. Thus, the screw 55 is rotatable in place in the flange 51.

Figure 4:
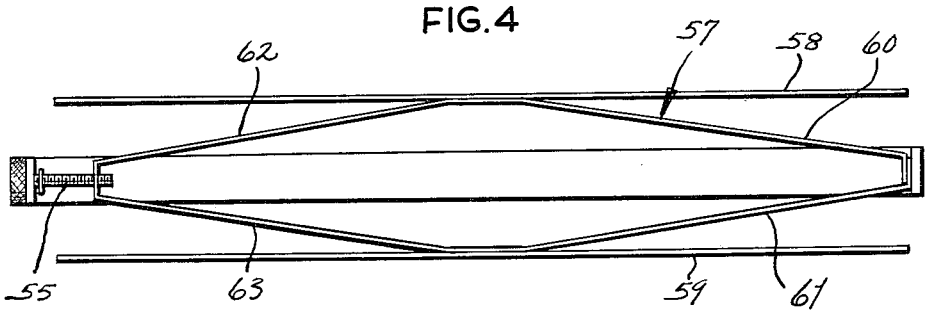
FIG. 4 is a bottom view of the divider alone in its expanded position.
Figure 5:
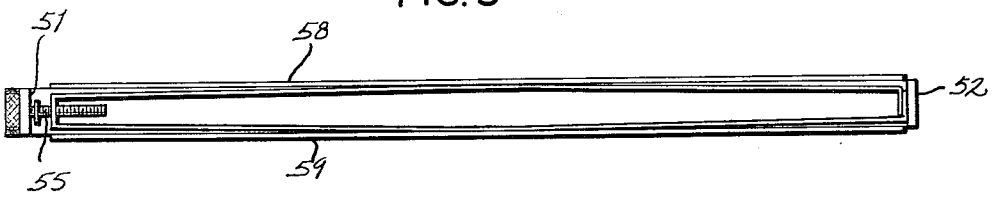
FIG. 5 is a bottom view of the divider alone in its contracted position.
Figure 6:
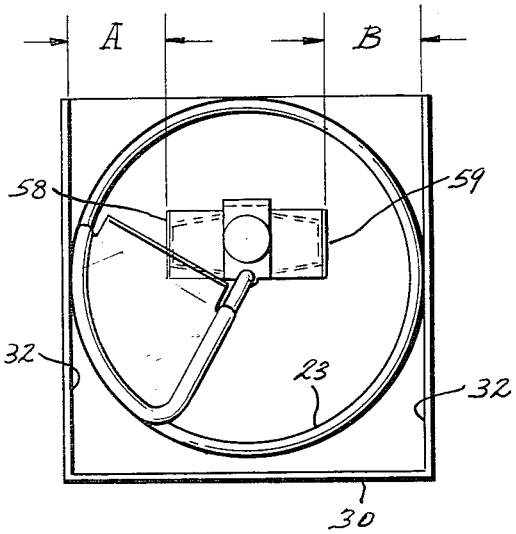
FIG. 6 is a front view of a vend unit showing the divider in its expanded position.

The means for adjusting the size of the vend compartments A and B comprises an expandible bracket 57 which carries opposed package guides 58 and 59 (FIGS. 4 and 5). The expandible bracket 57 is formed by legs 60, 61, 62 and 63 which are anchored to the rear flange 52, and are provided with a threaded opening 64 at their forward ends. The opening 64 accommodates the adjusting screw 55 in threaded engagement. Thus, when the adjusting screw 55 is rotated in a first direction, it moves the bracket 57 away from the front flange 51 causing the legs 60 and 61, as well as the legs 62 and 63, to move away from each other into the areas A and B (FIG. 6). The package guides 58 and 59 are secured to the brackets 57 between legs 60 and 62, and the legs 61 and 63, respectively. Thus, the package guides 58 and 59 (which are parallel to the tray side walls 32) move toward or away from the side walls 32 with the legs 60, 61, 62 and 63 in response to the direction of the adjustment screw 55.

Figure 7:
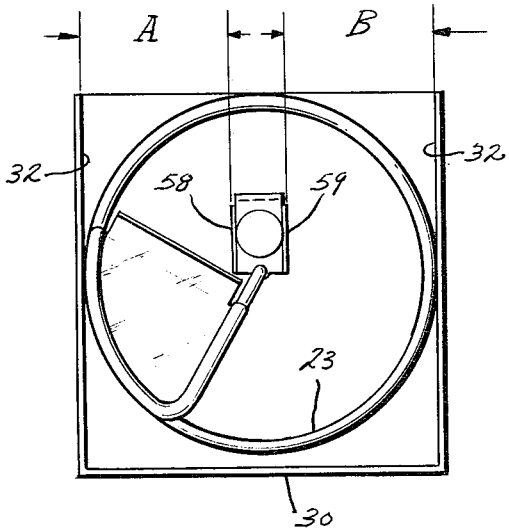
FIG. 7 is a front view similar to FIG. 6 with the divider in its contracted position.

When the divider 24 is in its closed position as shown in FIG. 7 and FIG. 5, the compartments A and B are at the maximum size and when the divider 24 is in its most expanded position as seen in FIG. 6 and FIG. 4, the compartments A and B are at their smallest size. Of course, any size in between these two extremes is possible by proper adjustment of the adjusting screw 55.

The expandible legs 60, 61, 62 and 63 also are journaled on the drive rod 35 by an opening 65 to suspend the helix 23 above the surface of the tray bottom wall 30, thus eliminating friction between the helix 23 and said bottom wall 30. This allows the packages within the helix convolutions to slide more easily toward the discharge end of the unit. This also helps prevent trapping of the bottom flange of the package between the helix 23 and the tray bottom wall 30.

What is claimed is:

1. A vending machine item discharge unit comprising:

(a) a tray means having side, rear and bottom walls, (b) helical means having a plurality of convolutions along its length to retain articles to be dispensed in the convolutions, (c) drive means connected to the helical means to rotate said helical means in predetermined increments upon activation by a customer, and (d) adjustable divider means positioned within the helical means and having elements movable laterally toward the tray side walls to change the spacing between the divider means and the tray side walls to compensate for articles of different width in the convolutions of the helix.

2. The unit of claim 1 wherein the helical means is connected to the drive means through the leading edge of the helix by means of a drive rod positioned within the convolutions of the helix, and wherein the drive rod also passes through a portion of the adjustable divider means and is rotatable with respect thereto.

3. The unit of claim 1 wherein the divider means comprises a main member having bent flanges on each end, the rearmost flange being fastened to the rear wall of the tray means and the forward flange journaling an adjusting screw; and an adjustable member having legs anchored at the rear end and connected to the adjusting screw at the forward end whereby rotation of the adjustment screw moves the legs laterally toward and away from the tray side walls to change the size of the compartments between the divider member and the tray sides.

4. The unit of claim 3 wherein package guides are fastened to the divider legs parallel to the tray sides, and move with the divider legs toward and away from the tray sides.

5. The unit of claim 4 wherein the divider forward flange also journals the drive shaft to thereby suspend the helix above the bottom wall of the tray.

6. The unit of claim 2 wherein the helical means is suspended from the bottom wall of the tray by means of its engagement with the adjustable divider means.

7. The unit of claim 6 wherein the divider means is fixed to the rear wall of the tray and the drive rod passes through and is journaled in a depending flange to hold the helical means above the bottom wall of the tray.

8. The unit of claim 6 wherein the divider means comprises a main member having bent flanges on each end, the rearmost flange being fastened to the rear wall of the tray means and the forward flange journaling the drive rod to suspend the helix above the bottom wall of the tray.

* * * * *